US009722368B2

(12) United States Patent
Kulas

(10) Patent No.: US 9,722,368 B2
(45) Date of Patent: Aug. 1, 2017

(54) CYLINDRICAL FOLDING CABLE

(71) Applicant: Charles J. Kulas, San Francisco, CA (US)

(72) Inventor: Charles J. Kulas, San Francisco, CA (US)

( * ) Notice: Subject to any disclaimer, the term of this patent is extended or adjusted under 35 U.S.C. 154(b) by 0 days.

(21) Appl. No.: 14/812,990

(22) Filed: Jul. 29, 2015

(65) Prior Publication Data

US 2016/0254076 A1 Sep. 1, 2016

Related U.S. Application Data

(60) Provisional application No. 62/030,366, filed on Jul. 29, 2014.

(51) Int. Cl.

| | |
|---|---|
| ***H01B 7/00*** | (2006.01) |
| ***H01R 24/58*** | (2011.01) |
| ***H04R 1/10*** | (2006.01) |
| *H04R 5/033* | (2006.01) |

(52) U.S. Cl.

CPC ..... *H01R 24/58* (2013.01); *H04R 1/1033* (2013.01); *H04R 5/033* (2013.01)

(58) Field of Classification Search

CPC ..... B29C 45/0055; B29C 45/14467; B29C 45/14573; B29C 2045/0058; B29L 2031/3462; H01B 7/06; H01B 7/40; H01B 7/292; H01B 13/0016; H01B 13/0036; H01R 13/72; H01R 24/58; H02G 3/04; H02G 11/00; H04R 1/1033; H04R 5/033; Y10T 29/49117

USPC ..... 29/423; 174/70 R, 74 R, 88 R, 110 R, 174/113 R, 135, 136; 264/272.11; 381/384; 439/447, 501

See application file for complete search history.

(56) References Cited

U.S. PATENT DOCUMENTS

| | | | | |
|---|---|---|---|---|
| 3,669,133 | A * | 6/1972 | Hyman | A45B 9/00 135/74 |
| 4,034,150 | A | 7/1977 | Burnett | |
| 5,080,591 | A * | 1/1992 | Forsyth | G09B 27/08 434/147 |
| 5,168,128 | A | 12/1992 | Thomsen | |
| 5,175,398 | A | 12/1992 | Hofmann | |
| 5,554,826 | A * | 9/1996 | Gentry | H01B 5/104 174/128.1 |
| 5,906,507 | A | 5/1999 | Howard | |
| 7,507,908 | B1 * | 3/2009 | Wu | H01B 7/06 174/11 R |
| 7,982,131 | B2 | 7/2011 | Fagrenius et al. | |
| 2002/0085828 | A1 * | 7/2002 | McGarvey | F16L 3/222 385/147 |
| 2002/0130624 | A1 * | 9/2002 | Nakamura | D02G 3/441 315/56 |
| 2007/0158096 | A1 * | 7/2007 | Katz | H02G 3/0475 174/111 |

(Continued)

OTHER PUBLICATIONS http:/www.quirky.com/products/229-Wired-ear-bud-organizers; Wired Bundle Your Buds; 4 pages.

*Primary Examiner* — Timothy Thompson
*Assistant Examiner* — Guillermo Egoavil

(57) ABSTRACT

Embodiments generally relate to a cable that substantially forms itself into a cylindrical shape when not extended, yet can be extended with a slight force to provide an electrical coupling as, for example, for earphones used with a mobile device such as a mobile phone.

7 Claims, 10 Drawing Sheets

(56) References Cited

U.S. PATENT DOCUMENTS

| | | | | |
|---|---|---|---|---|
| 2009/0239670 | A1* | 9/2009 | Ream | A63B 6/02<br>472/92 |
| 2009/0314515 | A1* | 12/2009 | Bevirt | H01B 7/40<br>174/11 R |
| 2012/0121120 | A1* | 5/2012 | Gorzelany | H02G 3/04<br>381/384 |
| 2012/0230533 | A1* | 9/2012 | Dallas | H04R 1/1033<br>381/384 |
| 2013/0200497 | A1* | 8/2013 | Murali | H01L 21/265<br>257/618 |

* cited by examiner

CYLINDRICAL FOLDING CABLE

CLAIM OF PRIORITY

This application claims priority from U.S. Provisional Patent Application Ser. No. 62/030,366, entitled "CYLINDRICAL FOLDING CABLE," filed on Jul. 29, 2014, which is hereby incorporated by reference as if set forth in full in this application for all purposes.

CROSS REFERENCES TO RELATED APPLICATIONS

This application is related to the following co-pending U.S. patent applications which are each incorporated by reference as if set forth in full in this document.

1. U.S. patent application Ser. No. 13/862,241, entitled "FOLDING ACCESSORY CABLE FOR PORTABLE ELECTRONIC DEVICES," filed on Apr. 12, 2013; and
2. U.S. patent application Ser. No. 14/154,002, entitled "NON-PLANAR FOLDING ACCESSORY CABLE FOR PORTABLE ELECTRONIC DEVICES," filed on Jan. 13, 2014.

DETAILED DESCRIPTION

Embodiments described herein are merely illustrative examples showing various features of folding cables. It should be apparent that many other variations of these features are possible that can provide additional embodiments that may fall within the scope of the claims.

Figure 2:
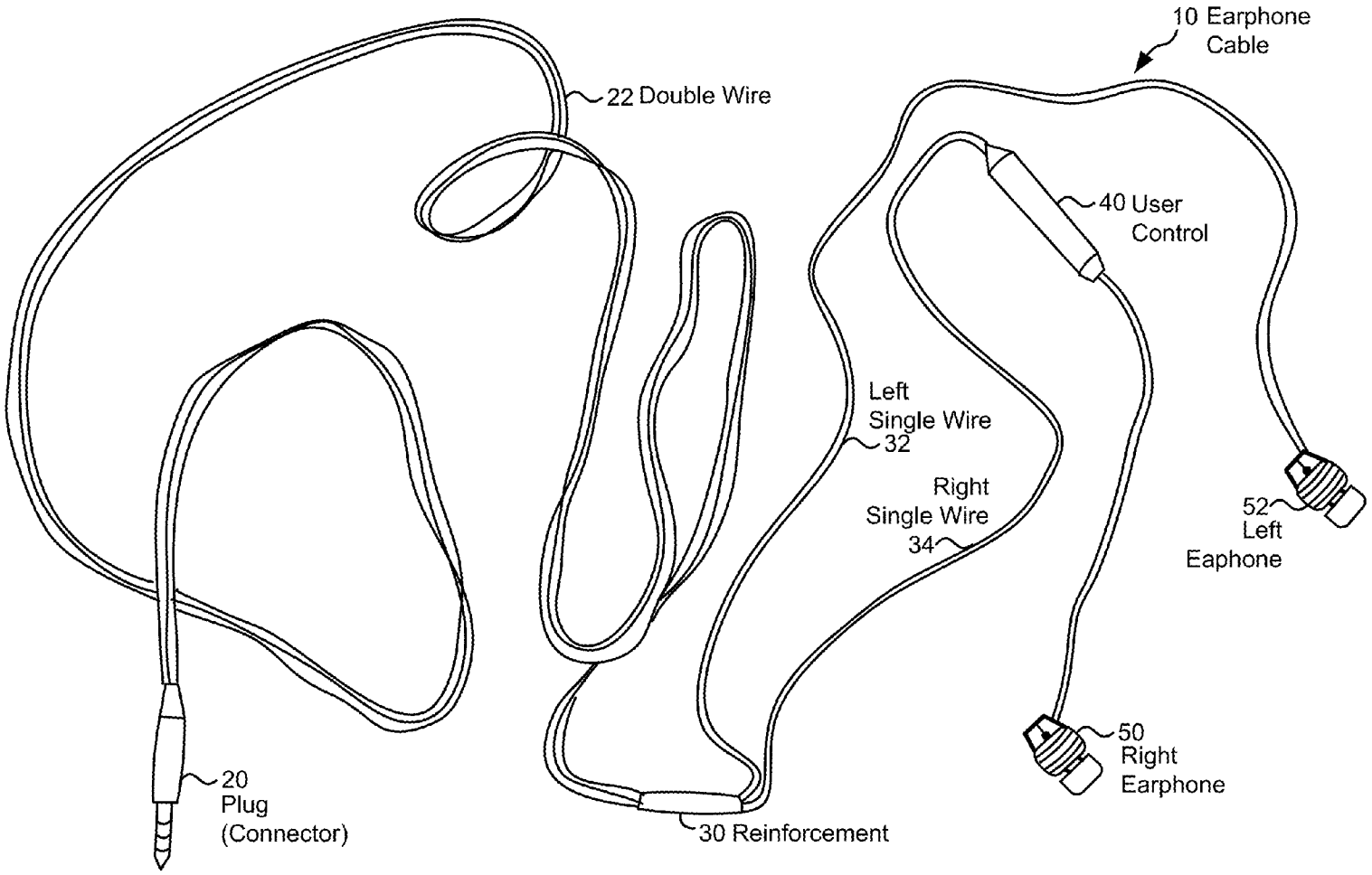
PRIOR ART Figure 2
FIG. 2 shows a prior art headphone cable.

FIG. 2 shows a prior art headphone cable 10. Headphone cable 10 includes various parts such as plug 20, a section of double wire 22, reinforcement 30, left single wire 32, right single wire 34, user control 40, right earphone 50 and left earphone 52. FIG. 2 shows but one example of a typical accessory cable. It should be apparent that many variations are possible.

In FIG. 2, plug 20 is used to connect the cable to a device such as a portable electronic device. Any type of plug, socket or other connector may be used such as a Universal Synchronous Bus (USB) connector, 2.5 mm, 3.5 mm, ¼ inch, etc. plugs; D-connector, coaxial, multi-pin connector, DIN connector, etc. The connector need not be mechanical but can be held in place at the device magnetically or by other means. In general, the connector can be any shape or type.

Figure 1:
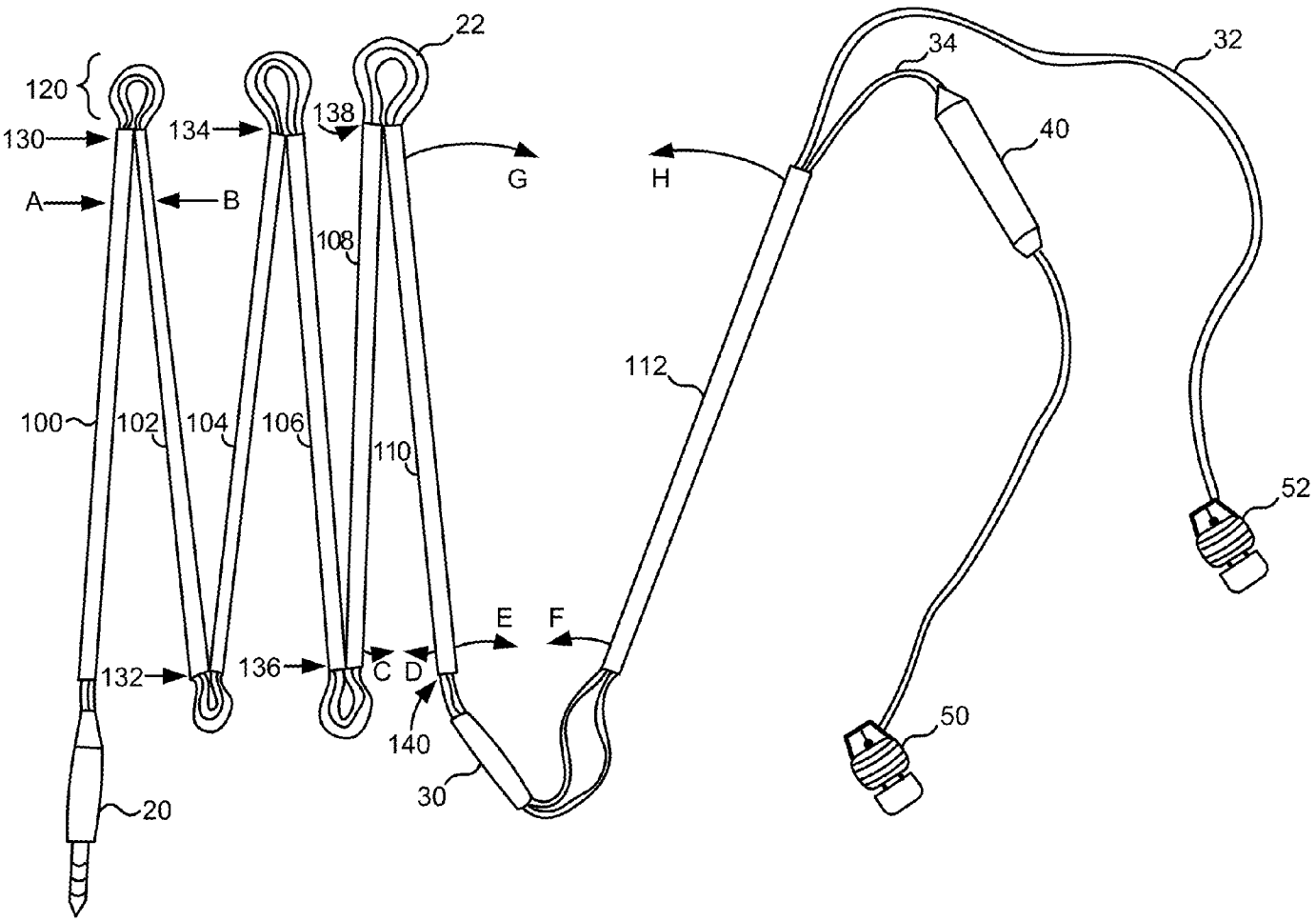
FIG. 1 illustrates a particular embodiment of a folding accessory cable.

A 2-conductor wire pair in the form of double wire 22 conveys electrical signals to and from plug 20. In the design of FIG. 1, the double-wire continues up to reinforcement 30 where it is split off into two single wires 32 and 34. Reinforcement 30 serves to prevent the double wire portion of the cable to be split into two wires as, for example, if a user were to cause a force to pull the two wires of the double wire apart. In other designs, no reinforcement part may be used as sometimes it can be desirable to allow a user to increase the length of the single wires by pulling the double wire portion apart.

To the right of reinforcement 30 is a section of single wire including left single wire 32 and right single wire 34. Although the wires may be referred to as "left" and "right" the user can use either wire for a left and or right side connection. Left single wire 32 is electrically coupled to left earphone 52 which fits into an ear of the user. Right single wire 34 connects to user control 40 and then continues to right earphone 50. User control 40 can include simple controls such as an on/off or "answer call" button, volume control, microphone or other sensor, etc. Either the left or right earphone may be used in the user's left or right ear. In other types of accessory cables, different parts may be used. Some parts may be omitted. For example, user controls may not be provided. There may be single wires along the entire length of a cable. More than two conductors may be used. An interconnection between the earphones may be provided.

Many different designs and types of accessory cables can be used. Any number of conductors may be included within a "wire." Although narrow gauge wires (e.g., 22 gauge or higher) are often used in accessory cables, any suitable gauge or conductor and/or insulator sizes can be used. Any suitable flexible material might be used for the insulation of a wire. Other types of cables need not terminate in separate earphones. For example, headphones provide a single assembly to which one or more wires can be connected. A plug can be provided on both ends so that the cable can connect an electronic device to another electronic device such as a cell phone connected to external speakers. Other arrangements are possible.

FIG. 1 illustrates a particular embodiment of a folding accessory cable. In FIG. 1, the cable of FIG. 2 has been fitted with stiff sections 100, 102, 104, 106, 108, 110 and 112. Items marked with the same reference numbers between FIGS. 1 and 2 indicate the corresponding components. Thus, FIG. 1 shows a folding cable assembly that includes the parts of FIG. 2 of plug 20, a section of double wire 22, reinforcement 30, left single wire 32, right single wire 34, user control 40, right earphone 50 and left earphone 52.

In FIG. 1, the cable of FIG. 2 has been fitted with stiff sections 100, 102, 104, 106, 108, 110 and 112. This provides a folded cable that when folded has a length (including wire loop sections and joints) that is comparable with the length of a cell phone or other small portable device (e.g., 8 cm to 15 cm long) so that the folded cable can be stored easily next to the cell phone of similar length. It should be apparent that other lengths of stiff sections are possible and any suitable length may be used.

In a particular embodiment pairs of ends of stiff sections abut each other and are movably joined at their endpoints to make successive joints to form an accordion-style configuration. In FIG. 1, stiff section 100's end at 130 is joined with stiff section 102's end which is also at 130. By making the join elastic, a force is placed on the stiff sections so that the joint at 130 moves stiff section 100 in the direction A and moves stiff section 102 in the direction B. This "folding force" quality of the joint at 130 causes stiff sections 100 and 102 to fold toward each other. Similarly, joint 132 causes stiff sections 102 and 104 to fold toward each other. Joint 134 causes stiff sections 104 and 106 to fold together. Joint 136 causes stiff sections 106 and 108 to fold together. Joint 138 causes stiff sections 108 and 110 to fold together. Note that complete folding is not necessary to obtain advantages. In general, any amount of folding force may provide benefits by causing the cable to compact itself and prevent tangling. In other embodiments, no folding force may be necessary and advantages may still be realized. For example, the presence of the stiff sections by themselves, without a folding force, will serve to keep the cable untangled. In such a case, the joints need not be present and one or more stiff sections can remain unattached from the others.

Not all of the stiff sections need to be handled in the same manner. For example, reinforcement 30 may make it impractical to use a joint at 140. In this case stiff section 112 can be unattached to the other stiff sections. In general, any manner of mixing different lengths, numbers and types of stiff sections with joints or other mechanisms for applying a force ("force mechanisms" as discussed below) can be employed, as desired. Different sizes of stiff sections can be used for a given cable. Different lengths of wire bends at the joints can be used, as shown at wire bend 120 in FIG. 2. Not all, or even most, of the cable need be provided with stiff sections. Any one or more wires or wire groups can be applied with one or more stiff sections. For example, stiff sections 100 through 110 are applied to double wire sections while stiff section 112 is applied to two separate single wire sections. Again, the number and characteristics of these stiff sections is optional and can change with different embodiments.

A wire is typically characterized by a conductor and surrounding insulation. Depending on the characteristics of the conductor—e.g., gauge, solid or stranded, metal type, etc.—and the type of insulation, the wire section can have different bending and elastic characteristics. As such, the choice of characteristics for the stiff sections will vary with design choice according to wire characteristics and other characteristics of the overall cable such as endpoints (connector, earphones, etc.), inter-cable variations (e.g., reinforcements, wire groupings (single, double, etc.) and the purpose or use of the cable. For example, if the cable is designed to be used with a mobile phone then it is often advantageous to have the cable fold to be about the same length as the mobile phone. Also, the force required to stretch out or lengthen the cable should be relatively low since otherwise the folding forces might readily pull the earphones out of the user's ears. In an application where the cable has mechanical connectors at each end then the folding forces can be larger since a plug, socket or other mechanical connector usually requires larger forces to disconnect than pulling an earphone out of an ear.

In the particular embodiment shown in FIG. 1, six stiff sections of approximately 9 to 10 cm in length and 2.5 to 3.5 mm in diameter are made of thin tube plastic such as polypropylene of approximately 0.15 to 0.25 mm thickness. In other embodiments, other sizes and types of materials (e.g., polystyrene, etc.) may be used and the shape need not be tubular. Each section is jointed to one other section including sufficient folding force to create a self-folding portion of the cable with 5 joints. An additional stiff section of approximately the same length as the others is used to cover a portion of the single wire run. In another embodiment, a joint could be provided to join stiff sections 110 and 112 and provide a folding force in the E and F directions. Additional attraction or folding forces can be applied in the direction G and H as discussed below. The stiff sections and joints or other mechanisms can be part of the design of the cable and created at a time of manufacture of the cable. Or the folding apparatus (i.e., stiff sections and joints or other mechanisms to apply a folding force) can be provided as an after-market add-on.

Figure 3:
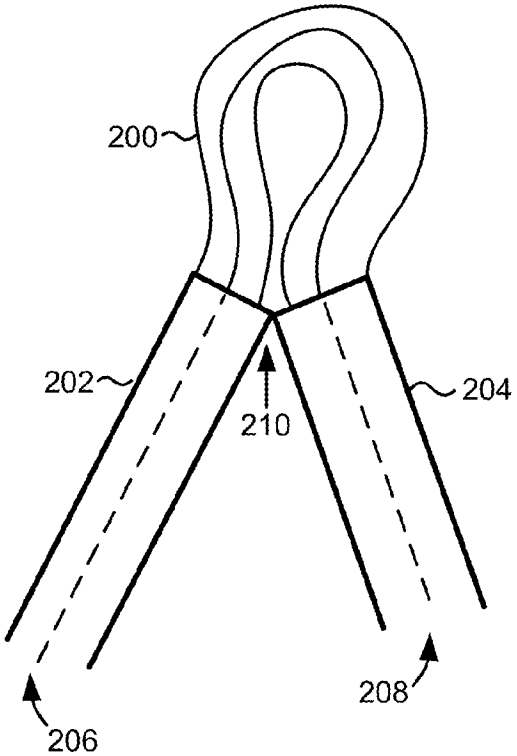
FIG. 3 illustrates details of an embodiment of a joint.

FIG. 3 illustrates details of an embodiment of a joint. In FIG. 3, wire bend 200 is shown near joint 210 between stiff sections 202 and 204. Dashed lines 206 and 208 represent cuts, or openings in the structure of stiff sections 202 and 204, respectively.

Figure 4:
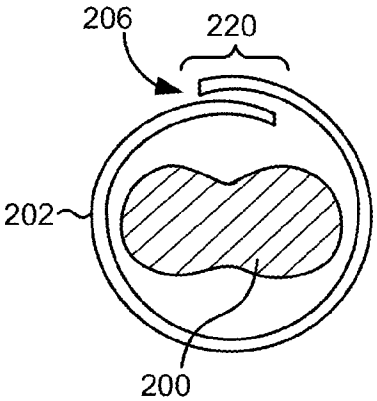
FIG. 4 shows a cross section of a stiff section.

FIG. 4 shows a cross section of stiff section 202 of FIG. 3. In FIG. 4, stiff section 202 has a cut 206 along its length so that stiff section 202 can be separated for insertion of wire 200. When allowed to close, stiff section 202 is elastic and has a "memory" of its shape so that it tends to close on itself with an overlap 220 to help seal and hold wire 200. Naturally, design tradeoffs can be made as to the thickness, diameter, material, elasticity, shape, length, etc. of stiff section 202, and any desirable design may be achieved. In other embodiments, the stiff section need not be self-closing, but may be closed or have the wire retained by other means such as with glue, zip-tie, elastic bands, velcro, snaps, zippers, or any suitable closing or retaining mechanism.

Figure 5:
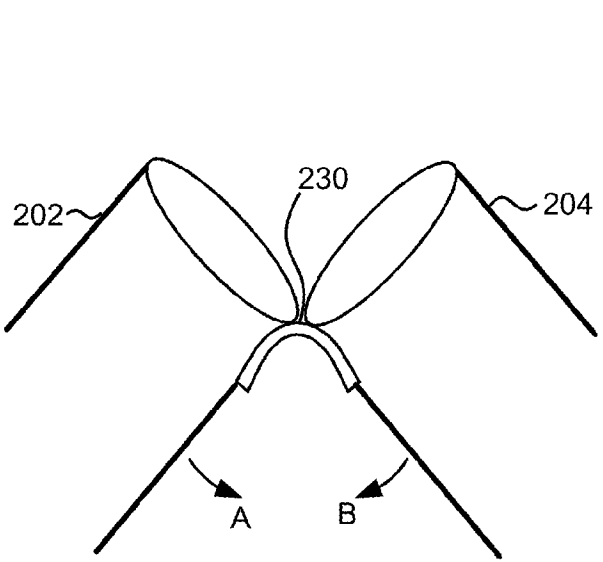
FIG. 5 illustrates a hinge forming a joint between stiff sections.

FIG. 5 illustrates a hinge 230 forming a joint between stiff sections 202 and 204. In one embodiment, hinge 320 is a force mechanism that causes a folding force to move stiff sections 202 and 204 toward each other in the direction A and B, respectively. In other embodiments, hinge 320 need not cause a folding force or may provide a negligible folding force or even an unfolding force (in the directions opposite to A and B). Such an unfolding force may be desirable, for instance, if it is desired for a cable to tend to be in an elongated configuration but still foldable as when a user folds the cable by hand. In various embodiments, the degree of force, and the mechanism for applying the folding, unfolding, or no or negligible, force is a design choice that can vary depending upon the particular application or use.

Figure 6:
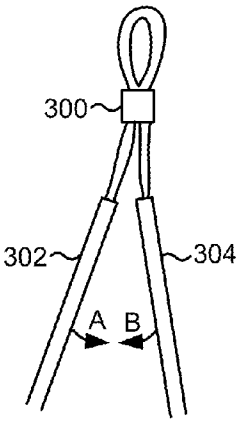
FIG. 6 illustrates a wire clamping mechanism in a first position.

FIG. 6 illustrates an embodiment whereby a clamping mechanism is used on the wire to cause a folding force in the direction A and B. In FIG. 6, clamp 300 causes the wires to be pushed together. Because the wires, themselves, have a stiffness, elasticity, and shape memory, they tend to push against the stiff sections 302 and 304 in the directions A and B, respectively. In this respect, the wire being held in place by the clamp acts as the force mechanism. The clamp can be made of any sufficient material and design. For example, in various embodiments any of the closing mechanisms mentioned, above, and any other suitable mechanisms now known or discovered in the future, may be used.

Figure 7:
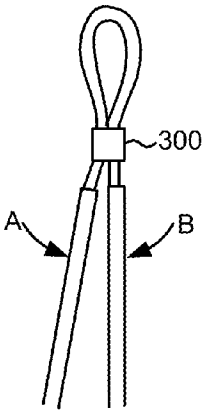
FIG. 7 illustrates a wire clamping mechanism in a second position.

FIG. 7 illustrates that as the clamping mechanism is moved closer to the stiff sections the folding force will tend to increase in the directions A and B.

Figure 8:
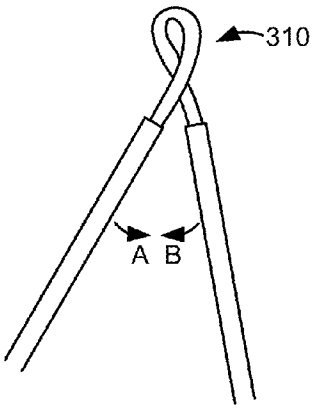
FIG. 8 shows an embodiment where there is a twist in the wire.

FIG. 8 shows an embodiment where there is a twist in the wire at 310 which can be used to apply a folding (or other)

force or to otherwise cause the cable to be organized more easily. As with all illustrations in this document, variations can be made such as to include a joint or additional ways to cause a folding force in the directions of A and B (or in other directions as described herein). The wire and cable design, and the design of the various components to apply a force to the cable can vary as described herein.

Figure 9:
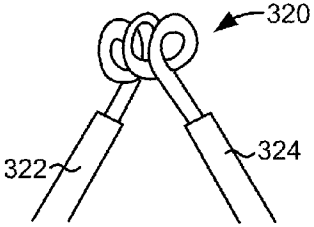
FIG. 9 shows an embodiment where the wire is subjected to multiple twists.

FIG. 9 is yet another embodiment where the wire is subjected to multiple twists or curls at 320 that may further increase or affect the desired force or otherwise influence the way the wire behaves with respect to the stiff sections 322 and 324.

Figure 10:
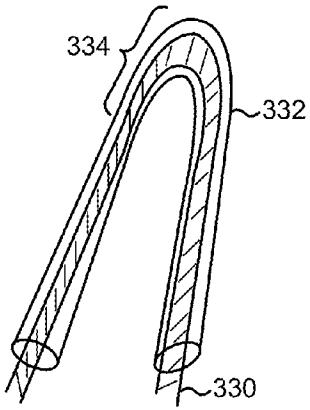
FIG. 10 shows a portion of a continuous stiff section including a bend.

FIG. 10 shows a portion of a continuous stiff section that can be integral with the wire or cable, or can be provided as a tray or tube or other separate part for mating with the cable. In FIG. 10, wire 330 is housed within stiff section 332. Stiff section 332 in this case has a pre-formed bend at 334 so that a small force (e.g., a user gently stretching the cable, effect of gravity on the cable hanging down from a user's ears, tension stretching the cable as it is connected between the user's ears and the device, etc.) will unbend the bend, yet when no force is applied (e.g., the user stops stretching the cable), or when a reverse force is applied (e.g., the user tries to fold up the cable), then the bend reverts back to its "unstressed" state of a predetermined bend as shown in FIG. 10.

Some embodiments using stiff sections and/or joints may be made as part of the cable itself at a time of manufacture. For example, stiff sections may merely be section that have more or different insulation than the other relatively non-stiff sections. Joints can be created as part of a molding of insulation or other materials. Additional parts can be affixed permanently or semi-permanently to the cable to achieve the embodiments described herein or to achieve the detailed effects.

Figure 11:
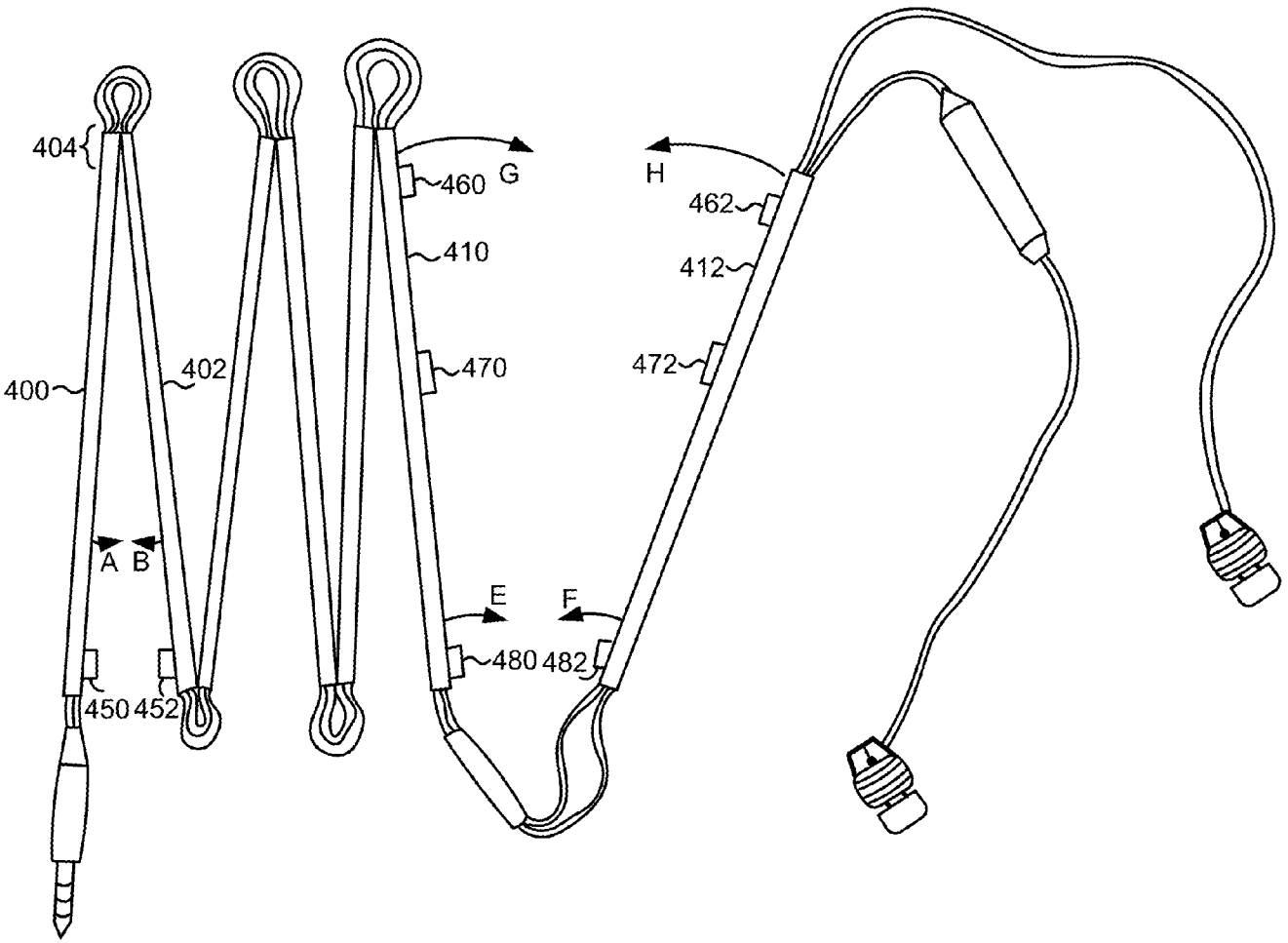
FIG. 11 shows folding by magnetic force.

FIG. 11 shows various embodiments whereby a force such as a folding force is applied magnetically. Magnets such as 450 and 452 can be used to cause an attractive or repulsive force between stiff sections such as 400 and 402. In an embodiment where the stiff sections 400 and 402 are joined at 404, magnets 450 and 452 can attract to cause folding forces in the directions A and B, respectively. In other cases where stiff sections are not joined, such as stiff sections 410 and 412, magnetic effects can be used at, for example, 460 and 462; 470 and 472; 480 and 482, etc. In some embodiments, pairs of magnets may not be necessary as one magnet may provide sufficient force by attracting the metal in the conductor of one or more portions of the wire. In general, any number, type and positioning of magnets may be used to create the desired forces.

In some embodiments that use magnetic attraction, stiff sections may not be needed. Or the stiff sections may have different arrangements than those shown herein. In one approach, discrete or visible magnetic elements need not be used as the insulation or stiff sections themselves may be made magnetic. For example, the wire insulation, stiff sections, or joints can be made from magnetic organic polymer, or magnetic rubber, etc. so that these parts may be inherently magnetic. An electromagnetic embodiment allows small electromagnets in locations such as those discussed in connection with FIG. 11, to be activated by a user control so that the cable can be activated to, for example, self-fold upon user activation. In this case an electrical circuit that can utilize the cable's own wires (or additional wires) to carry the current for the electromagnetic actuation can be used, along with a battery or other power supply. The power supply can be part of the cable or can be obtained from a host device, inductively through the air, by solar electricity, or from other sources. In some embodiments, the electromagnetic effect need only be activated momentarily so that the cable can be easily gathered and stored and then the electromagnetic effect can be stopped.

Figure 12:
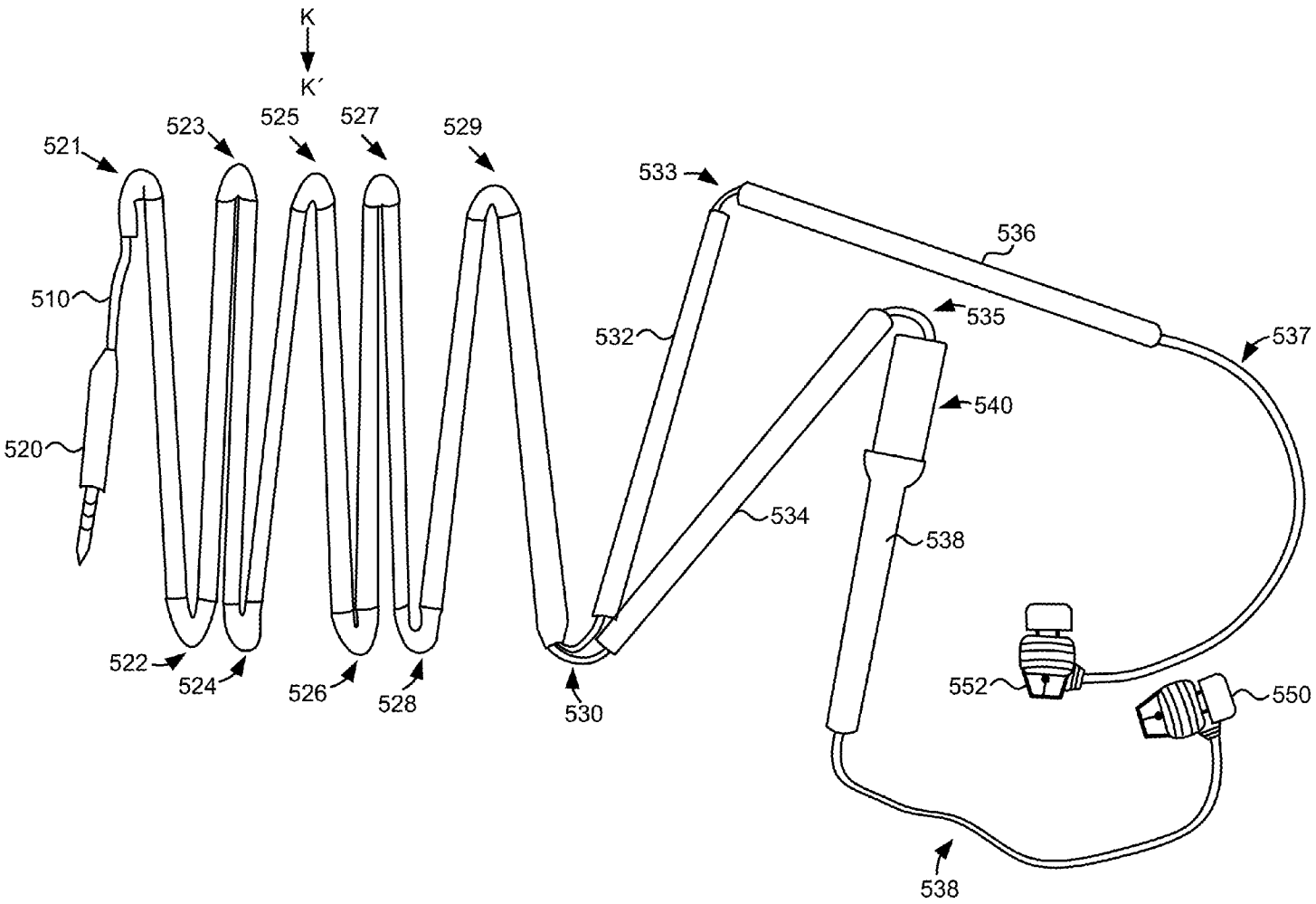
FIG. 12 shows a particular embodiment of a folding cable.

FIG. 12 illustrates a particular embodiment of a folding cable. The illustration of FIG. 12 is approximately to scale. Naturally, any desirable length may be used and other specifics such as number of joints, stiff sections, placement of the joints and bends, materials used, type and location of controls, shape or design of components, etc., may vary.

Cable 510 is standard cable used for headphones that does not provide much stiffness. In the embodiment of FIG. 12, the cable length shown as 510 enters a sheath that provide a folding force at joint 521. In a particular embodiment, the sheath can be formed of ¼" (expanded diameter, ⅛" recovered) heat shrink tubing. Joint 521 is formed before shrinking the tubing and held in place while heat is applied in order to form a joint 521 that can be unbent but then tries to return to its former, bent state.

Stiff sections between adjacent joints 521-530 are formed of 1.5 mm carbon fiber circular solid rods. The heat shrink sheath is maintained as a continuous run along the length of the cable. The carbon fiber rods serve to keep the stiff sections rigid. Bends such as at 522-529 are formed without any carbon fiber rod within them, in the manner described above for joint 521. Note that the embodiment of FIG. 12 is but one embodiment and many other ways to form stiff sections and joints may be used; some of which are described herein.

In the design of FIG. 12, the combination of plug 520, cable length 510 and portion of joint 521 are approximately the same length as the stiff sections between joints 521-530. This approach allows the plug 520 portion to lie within the same length as the folded cable, unlike the design of FIG. 1, for example. Cable 510 portion is short enough that the cable, itself, provides some tendency to remain straight when the cable is not stretched out.

Joint 530 does not use any sheath portion so that joint 530 does not have an associated folding force. In this illustrated embodiment, joint 530 allows the cable to exit the sheath as two separate cables from the single cable. Thus, the joint at 530 also serves as the reinforcement point (or "Y-connector") for the cable to split into two cables for the left and right earphone connections to earphones 552 and 550, respectively. Stiff sections at 532, 534, 536 and 538 are not provided with folding forces at their joints. This tends to allow the portions of the folding cable that are closest to a user's face to not bunch up around the face. Naturally, other designs can be used such as a portion from the y-connector to the earphones having less, more, or no stiff sections. And to have joints with folding force, as desired. Portions of the cable from 530 to the earphones can be made pliable or have different properties than the folding part of the cable from 521 through 530.

Figure 13:
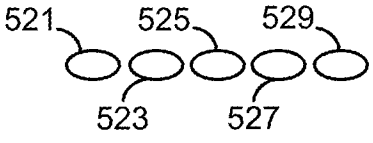
FIG. 13 illustrates a first example of non-planar folding.

FIG. 13 shows an image of joints 521, 523, 525, 527 and 529 viewed end-on along the line K-K' in FIG. 12. The view shown in FIG. 13 shows each of the 5 joints lining up in a single row, one after the other. Such a folding pattern allows the cable, when folded, to lie flat on a table or other surface. However, other arrangements of joints that go out of the plane of the paper of FIG. 12 are possible.

Figure 14:
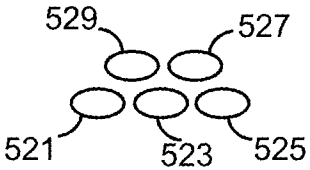
FIG. 14 illustrates a second example of non-planar folding.

For example, FIG. 14 shows an illustration whereby the joints form two rows. A first row includes joints 521, 523 and 525; while a second row includes joints 527 and 529. Any other number of rows with different numbers of joints may be formed. By causing one or more joints to have a rotational, or twisting, force (alone or in addition to the folding force or another force) it is possible to have non-planar folding that may be desirable to provide a more compact or better fitting shape, or for other reasons. For example, where a sheath is used as describe above, the sheath can be formed over the cable to provide a folding force at a joint and also include a twisting force to achieve the patterns shown in FIGS. 13-15. Other ways to provide a twisting and/or folding force may be used, including those techniques described herein. Preferably, the force mechanisms will be applied at a time of manufacture and can use a minimum of additional components. One approach would use the cable's own insulation to provide the folding and/or twisting forces so that the folding and/or twisting mechanism could be integral with the design of the cable. This can be achieved by using different materials for the cable insulation, wire, filler or other parts of the cable. The material could be selected to have sufficient strength, elasticity, memory, stiffness, and other properties, as desired.

Figure 15:
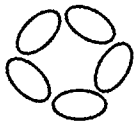
FIG. 15 illustrates a third example of non-planar folding.

FIG. 15 shows another example of "circular" folding of the cable as illustrated by joints 521, 523, 525, 527 and 529 arranged in a circular fashion. The circular folding may have advantages that it fits better in a hand or a pocket. The non-planar folding designs may produce less tangling or have other advantages. The non-planar folding designs may also be more aesthetically pleasing or be more desirable in other ways. Many other types of folding patterns may be achieved.

Although particular embodiments have been described, many variations are possible. For example, although the embodiments have been described primarily with respect to hardwired cables, other types of electrical or communication cables can be used. Fiber optic cables may be susceptible for use with functionality discussed herein.

Larger devices that may be adaptable for use with features described herein even though the devices may be considered too large for easy "handheld" or "portable" operation. For example, tablet or slate computers such as the iPad™ by Apple Computer, Inc. can be used even though these devices are significantly larger than cell phones.

Any suitable programming language can be used to implement the routines of particular embodiments including C, C++, Java, assembly language, etc. Different programming techniques can be employed such as procedural or object oriented, scripts, interpreted or compiled code, etc. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nano-engineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

Figure 16:
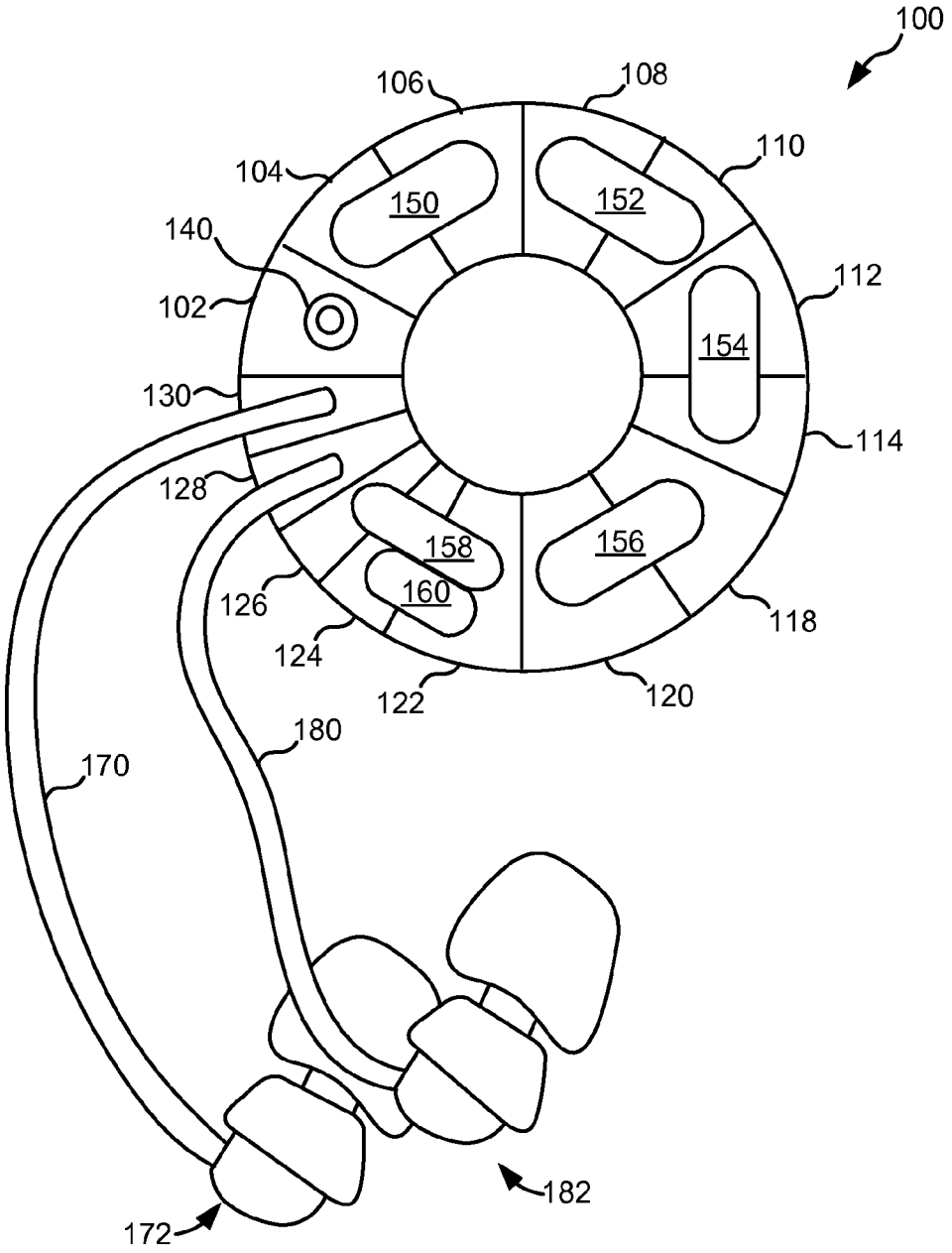
FIG. 16 illustrates a cross-sectional view of an embodiment of the cylindrical cable system in a closed form.

FIG. 16 illustrates a cross-section view of an embodiment of a cylindrical, self-folding cable in a closed form, also referred to as a resting state, in which the cable is not being applied with extending forces to stretch the cable out. In FIG. 16, folding cable 100 is able to fold and loosely contain itself so that most, substantially all, or all of the cable retains roughly the shape of a cylinder. Since this is a cross-section view, the cylinder appears circular.

Figure 17:
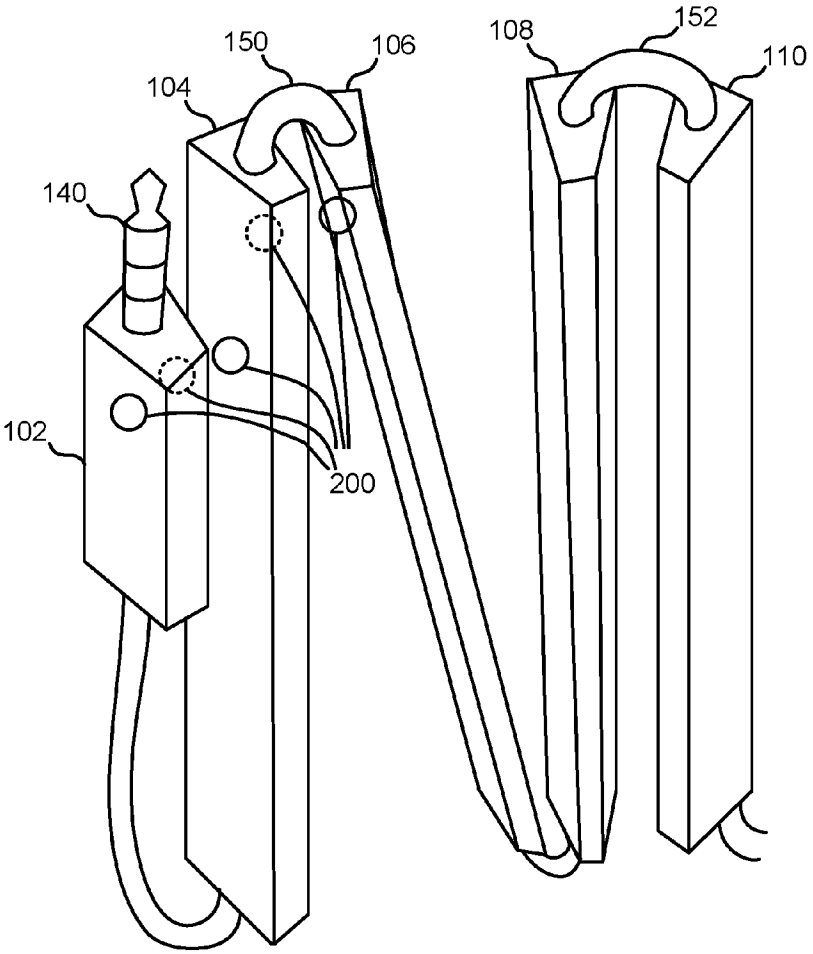
FIG. 17 shows a perspective view of a portion of the embodiment of FIG. 16 in a partially expanded form.
Figure 18:
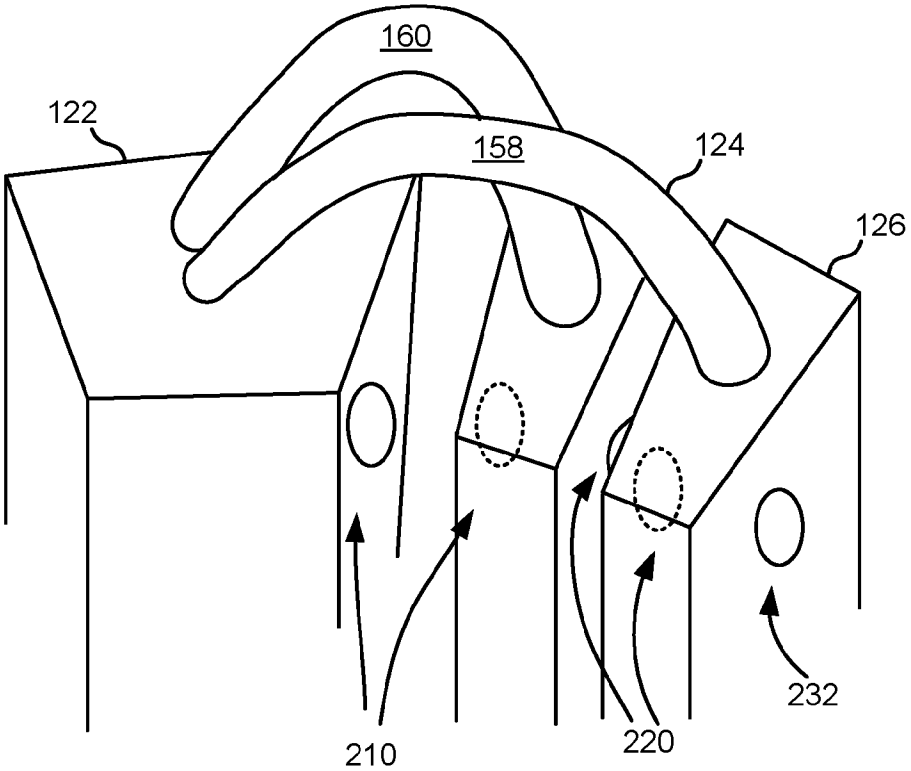
FIG. 18 shows a detail view of a portion of the embodiment of FIG. 16 in a partially expanded form.

The cylinder is made up of separable sections 102 through 130. Some of these same sections are shown in FIGS. 17 and 18 where parts of the folding cable are illustrated in perspective views. Returning to FIG. 16, cable portions 150 through 160 protrude from the sections at one end of the cylinder. In this embodiment, cable 150 joins sections 104 and 106, cable 152 joins sections 108 and 110, etc. If this cylinder is viewed from the other side then cable portions would be visible that join sections 106 and 108, 110 and 112, etc. In this embodiment, the cable is a set of continuous conductors that can be folded in the manner described herein.

Small magnets are shown in FIGS. 17 and 18 as 200, 210, 220 and 232. These form pairs that serve to attract the sections together to help the cylinder form together while not requiring too much force to separate the sections. In other embodiments, such magnets may not be needed. The magnets can be positioned in different places or can be substituted with other mechanisms to provide attraction such as electrostatic, mechanical (Velcro™, etc.), chemical (glue, etc.). Magnets or other attracting mechanisms can be any shape, size, or number. Many such variations are possible.

Although the description and Figures may include particular dimensions, shapes, materials or other details, it should be apparent that many such design choices can be made to achieve other embodiments without departing from the scope of the claims. In a particular embodiment, the cable material, itself, can be provided with characteristics of stiffness, elasticity, shape memory, etc., so that the cable folds in the manner described herein without having additional shape modification such as the sectional parts shown in the Figures.

Although the description has been described with respect to particular embodiments thereof, these particular embodiments are merely illustrative, and not restrictive. Any suitable programming language may be used to implement the routines of particular embodiments including C, C++, Java, assembly language, etc. Different programming techniques may be employed such as procedural or object-oriented. The routines may execute on a single processing device or on multiple processors. Although the steps, operations, or computations may be presented in a specific order, the order may be changed in particular embodiments. In some particular embodiments, multiple steps shown as sequential in this specification may be performed at the same time.

Particular embodiments may be implemented in a computer-readable storage medium (also referred to as a machine-readable storage medium) for use by or in connection with an instruction execution system, apparatus, system, or device. Particular embodiments may be implemented in the form of control logic in software or hardware or a combination of both. The control logic, when executed by one or more processors, may be operable to perform that which is described in particular embodiments.

A "processor" includes any suitable hardware and/or software system, mechanism or component that processes data, signals or other information. A processor may include a system with a general-purpose central processing unit, multiple processing units, dedicated circuitry for achieving functionality, or other systems. Processing need not be limited to a geographic location, or have temporal limitations. For example, a processor may perform its functions in "real time," "offline," in a "batch mode," etc. Portions of processing may be performed at different times and at different locations, by different (or the same) processing systems. A computer may be any processor in communication with a memory. The memory may be any suitable processor-readable storage medium, such as random-access memory (RAM), read-only memory (ROM), magnetic or optical disk, or other tangible media suitable for storing instructions for execution by the processor.

Particular embodiments may be implemented by using a programmed general purpose digital computer, by using application specific integrated circuits, programmable logic devices, field programmable gate arrays, optical, chemical, biological, quantum or nanoengineered systems, components and mechanisms. In general, the functions of particular embodiments may be achieved by any means known in the art. Distributed, networked systems, components, and/or circuits may be used. Communication or transfer of data may be wired, wireless, or by any other means.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope to implement a program or code that is stored in a machine-readable medium to permit a computer to perform any of the methods described above.

As used in the description herein and throughout the claims that follow, "a", "an", and "the" include plural references unless the context clearly dictates otherwise. Also, as used in the description herein and throughout the claims that follow, the meaning of "in" includes "in" and "on" unless the context clearly dictates otherwise.

While one or more implementations have been described by way of example and in terms of the specific embodiments, it is to be understood that the implementations are not limited to the disclosed embodiments. To the contrary, they are intended to cover various modifications and similar arrangements as would be apparent to those skilled in the art. Therefore, the scope of the appended claims should be accorded the broadest interpretation so as to encompass all such modifications and similar arrangements.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What is claimed is:

1. A folding cable comprising:

a connector at one end of the cable for electrically coupling the cable to a device;

one or more transducers at another end of the cable for conveying a signal to a human user;

a plurality of stiff sections along the cable formed so that at least a portion of the cable forms into a shape of at least a portion of a cylinder when the cable is in a resting state, wherein first and second stiff sections each have two opposing side faces, wherein the opposing side faces are closer together toward the center of the cylinder, or portion thereof, when the first stiff section is positioned with one of its side faces adjacent to a side face on the second stiff section so that the cable is folded into the shape of at least a portion of the cylinder, wherein one or more smaller stiff sections span a smaller radial angle than one or more other stiff sections which are larger than the smaller stiff sections.

2. The folding cable of claim 1, further comprising:

a particular larger stiff section including first and second conductors of the cable exiting from a top face of the particular larger stiff section;

a first smaller stiff section adjacent to the particular larger stiff section; and a second smaller stiff section adjacent to the first smaller stiff section, wherein the first conductor is coupled to the first smaller stiff section and the second conductor is coupled to the second smaller stiff section.

3. The folding cable of claim 2, wherein the first conductor and second conductor have a same length.

4. The folding cable of claim 1, further comprising:

9 larger stiff sections; and 4 smaller stiff sections.

5. A folding cable comprising:

a connector at one end of the cable for electrically coupling the cable to a device;

one or more transducers at another end of the cable for conveying a signal to a human user; and a plurality of stiff sections along the cable formed so that at least a portion of the cable forms into a shape of at least a portion of a cylinder when the cable is in a resting state, wherein first and second stiff sections each have two opposing side faces, wherein the opposing side faces are closer together toward the center of the cylinder, or portion thereof, when the first stiff section is positioned with one of its side faces adjacent to a side face on the second stiff section so that the cable is folded into the shape of at least a portion of the cylinder, wherein a shorter stiff section has a shorter length than one or more other stiff sections, the shorter stiff section further comprising:

a conductor protruding from a face of the shorter stiff section; and a plug coupled to a face of the shorter stiff section.

6. The folding cable of claim 5, wherein the plug is adjacent to the shorter stiff section.

7. The folding cable of claim 5, wherein the plug is coupled to the shorter stiff section by a length of conductor.

* * * * *